US005709043A

United States Patent [19]

Jones et al.

[11] Patent Number: 5,709,043

[45] Date of Patent: Jan. 20, 1998

[54] EXCAVATING TOOTH

[75] Inventors: Larren F. Jones, Aloha; Robert K. Emrich, Tigard, both of Oreg.

[73] Assignee: Esco Corporation, Portland, Oreg.

[21] Appl. No.: 570,438

[22] Filed: Dec. 11, 1995

[51] Int. Cl.[6] ..... E02F 9/28

[52] U.S. Cl. ..... 37/458; 403/355; 37/455

[58] Field of Search ..... 37/446, 448, 450, 37/451, 453, 455, 458, 456; 403/355; 172/70.12, 713, 753, 772, 772.5, 717; 299/108

[56] References Cited

U.S. PATENT DOCUMENTS

| | | | |
|---|---|---|---|
| D. 352,044 | 11/1994 | Hahn . | |
| 2,435,846 | 2/1948 | Robertson . | |
| 2,689,419 | 9/1954 | Daniels et al. . | |
| 2,861,362 | 11/1958 | Liard et al. . | |
| 2,885,801 | 5/1959 | Hill . | |
| 3,023,521 | 3/1962 | Brunner, Jr. . | |
| 3,117,386 | 1/1964 | Ferwerda . | |
| 3,196,956 | 7/1965 | Ratkowski . | |
| 3,774,324 | 11/1973 | LaFond . | |
| 3,851,413 | 12/1974 | Lukavich | 37/451 |
| 4,231,173 | 11/1980 | Davis . | |
| 4,233,761 | 11/1980 | Ryerson . | |
| 4,335,532 | 6/1982 | Hahn et al. . | |
| 4,338,736 | 7/1982 | Radigan | 37/458 |
| 4,404,760 | 9/1983 | Hahn et al. . | |
| 4,433,496 | 2/1984 | Jones et al. . | |
| 4,481,728 | 11/1984 | Mulder et al. | 37/452 |
| 4,751,785 | 6/1988 | Johansson et al. . | |
| 4,903,420 | 2/1990 | Kreitzberg et al. . | |
| 4,932,478 | 6/1990 | Jones . | |
| 4,965,945 | 10/1990 | Emrich . | |
| 5,009,017 | 4/1991 | Diekevers et al. | 37/456 |
| 5,088,214 | 2/1992 | Jones . | |
| 5,241,765 | 9/1993 | Jones et al. . | |
| 5,272,824 | 12/1993 | Cornelius . | |
| 5,337,495 | 8/1994 | Pippins . | |
| 5,386,653 | 2/1995 | Cornelius . | |
| 5,423,138 | 6/1995 | Livesay et al. . | |
| 5,456,029 | 10/1995 | Cornelius | 37/455 X |
| 5,469,648 | 11/1995 | Jones et al. . | |

OTHER PUBLICATIONS

Advertisement for "New Tuf-Tip® Teeth?", Page Engineering Company. (no date).

*Primary Examiner*—Henry E. Raduazo
*Assistant Examiner*—Robert Pezzuto
*Attorney, Agent, or Firm*—Banner & Witcoff, Ltd.

[57] ABSTRACT

An excavating tooth for attachment to the digging edge of excavating equipment includes a wear member provided with bearing faces in a socket which extend substantially parallel to the longitudinal axis of the tooth. The bearing faces are formed to widen significantly as they extend rearward to provide broad bearing surfaces at the rear ends of the wear member. The bearing faces are placed between the converging walls and the side walls of the socket at obtuse angles thereto to avoid areas of stress concentration. The bearing faces are further formed in a plurality of tiers to provide enhanced resistance to vertically applied loads at the front end of the member. The wear members are further secured to the adapter by locks which ease installation and removal of the wear members.

40 Claims, 12 Drawing Sheets

EXCAVATING TOOTH

FIELD OF THE INVENTION

The present invention pertains to an excavating tooth for attachment to the digging edge of an excavator.

BACKGROUND OF THE INVENTION

Excavating teeth have long been mounted along the digging edge of buckets and other excavating equipment to break up the ground and enhance the digging operation. The teeth are ordinarily formed of a plurality of parts to reduce the size of the outer wear member needing frequent replacement. In general, an excavating tooth comprises an adapter, a point, and a lock to secure the point to the adapter. The adapter has a rear mounting end which is configured for attachment to the digging edge of an excavator and a forwardly projecting nose for mounting the point. The point is a tapered wedge-shaped member provided with a forward digging edge and a rearwardly opening socket adapted to be received over the adapter nose.

Excavating teeth are commonly subjected to heavy loading by large forces applied in a wide variety of directions. As a result, the points must be firmly secured to the adapter to withstand not only axial forces but vertical and laterally directed forces as well. Vertical loads have been particularly troublesome in that they generate large moment forces which tend to rotate the point from the adapter. While the tapering walls of the adapter nose provide support for the point, the lock plays a large role in resisting these moment forces.

In addition, wearing of the tooth components causes looseness in the connection which in certain circumstances can result in the pin, and hence, the point being lost. In an effort to increase the life of the assembly, the pin is usually set very tightly in the defined opening. Consequently, the pin is forcibly driven into and out of the opening. The pin is typically inserted by repeated blows with a heavy sledge hammer. As can be appreciated, this is an onerous and time-consuming task, especially in the larger sized teeth.

In a further effort to alleviate loss of the point, an elastomer is often placed in front of the pin to maintain a tight fit between the point and the adapter. While the elastomer functions to pull the point onto the adapter, it also reduces the lock's ability to resist the applied moment forces. More specifically, under moment loading the point is driven in a generally rotating direction about the adapter nose. Accordingly, if a downward load is applied to the front of the point, the rearward upper side of the point tends to be pulled forward and upward. This movement pushes the pin against the elastomer, which provides greater freedom of movement for the point, and thus a greater risk of being lost.

To reduce the reliance on the lock pin for retaining the point, efforts have been made to form a connection which provides greater stability for the point. U.S. Pat. No. 4,231,173 to Davis discloses a tooth wherein the apices of the adapter nose and the socket are formed to have a box-shape. In this construction, planar faces extend generally parallel to the axis of the tooth along the top and bottom of the nose to provide a greater resistance to rotation of the point under moment loads than noses which have tapering walls across their entire length. The tooth of the Davis patent further includes rearward tabs received in recesses for providing additional resistance to the moment forces. However, since the tabs extend outward from the body of the point they possess less resistance strength.

U.S. Pat. Nos. 3,196,956 to Ratkowski and 5,423,138 to Livesay et al. have provided planar bearing surfaces which lie parallel to the axis of the tooth along the rearward portions of the nose. The rearward placement of these bearing surfaces will provide a level of stability in resisting the moment forces. However, the use of these surfaces results in sharp corners being formed in the nose and the socket. The creation of such corners causes greater stress concentrations at these points under load, which in turn, weakens the overall strength of the tooth.

Page Engineering Company has produced a tooth which includes two sets of bearing faces along the top and bottom walls of the nose. The bearing faces are generally parallel to the axis of the tooth. However, the use of such bearing faces along the rear end of the nose disrupts the formation of a smooth transition between the nose and the legs. As a result, the transition structure is susceptible to high stress concentrations and an increased risk of failure. To overcome the weakness in the Page tooth, U.S. Pat. No. 4,233,761 discloses the use of ridges along the nose to provide greater strength. While the ridges would augment the strength of the nose, the design does not eliminate the high stress points in the nose. Moreover, the formation of grooves along the inside of the point would result in the point being weaker and more susceptible to failure.

SUMMARY OF THE INVENTION

The present invention pertains to an excavating tooth which provides an enhanced stability to the mounting of the point. In particular, the nose of the adapter and the socket of the point are provided with bearing faces which extend substantially parallel to the longitudinal axis of the tooth. The bearing faces are able to better resist the vertical thrust and moment forces which are applied during vertical loading on the front end of the point.

In one aspect of the invention, the nose and socket are each defined by a pair of top and bottom converging walls, a pair of side walls, and two sets of bearing faces extending substantially parallel to the axis of the tooth. The bearing faces are formed in tiers so that one set of bearing faces is spaced farther from the longitudinal axis of the tooth than the other set of bearing faces. The rear bearing faces are located along the corners of the nose (i.e., at the junctures of the top and bottom walls with the sidewalls). In this way, the tooth is better able to provide strong resistance to the applied vertical loads without creating higher stress points in the transition between the nose and the mounting portion.

In another aspect of the invention, the bearing faces widen significantly as they extend in a rearward direction. As a result, a broad bearing surface is provided at the rear end of the point and adapter to provide enhanced resistance to the applied moment forces.

In another aspect of the invention, the nose and socket are each defined by a pair of top and bottom converging walls, a pair of side walls, and a plurality of bearing faces extending substantially parallel to the axis of the tooth. A bearing face is provided between the side and converging walls at obtuse angles thereto. With this construction, the formation of sharp corners with their attendant high stress concentrations, as in the prior art, are avoided.

In another aspect of the invention, an extensible, reusable lock is employed to secure a wear member to an adapter. The lock includes a casing, a lock pin movably received in the casing, and a driver for moving the lock pin into a locking position with the wear member. The extensible nature of the lock permits easy installation and removal of the wear member, and obviates the need to drive the lock into or out of position with repeated blows of a sledge hammer.

In another aspect of the invention, a wear member adapted for use with an extensible lock is provided with a hole extending along a transverse axis. The hole includes a rear face which either may be a single surface that converges toward the transverse axis of the hole as it extends outward, or may be a two segmented surface, the inner segment of which converges toward the transverse axis of the hole as it extends outward, and the outer segment of which transitions to a substantially parallel alignment to the transverse axis to avoid unduly closing the hole. In either case, the transversely converging surface engages the bearing face of the lock pin for locking and tightening of the point onto the adapter.

In another aspect of the invention, the wear member is secured to the adapter by a rigid lock member provided with a front convex bearing face adapted to engage a surface of the adapter, and a rear concave bearing face adapted to engage a surface of the wear member. The rigid lock further includes a resilient latch which is releasably retained by a keeper defined on the point to prevent inadvertent release of the lock from the tooth assembly.

DETAILED DESCRIPTION OF THE PREFERRED EMBODIMENTS

The present invention pertains to excavating teeth which attach to the digging edge of an excavator. While the present application discusses the use of the teeth only in connection with their attachment to an excavating bucket, they can be secured to a wide range of excavating equipment. Further, operation of the equipment will cause the teeth to assume many different orientations. Nevertheless, for purposes of explanation, the elements of the teeth are at times described in regard to relative directions such as up and down. These directions should be understood with respect to the orientation of the tooth as shown in FIG. 1, unless stated otherwise.

Figure 5:
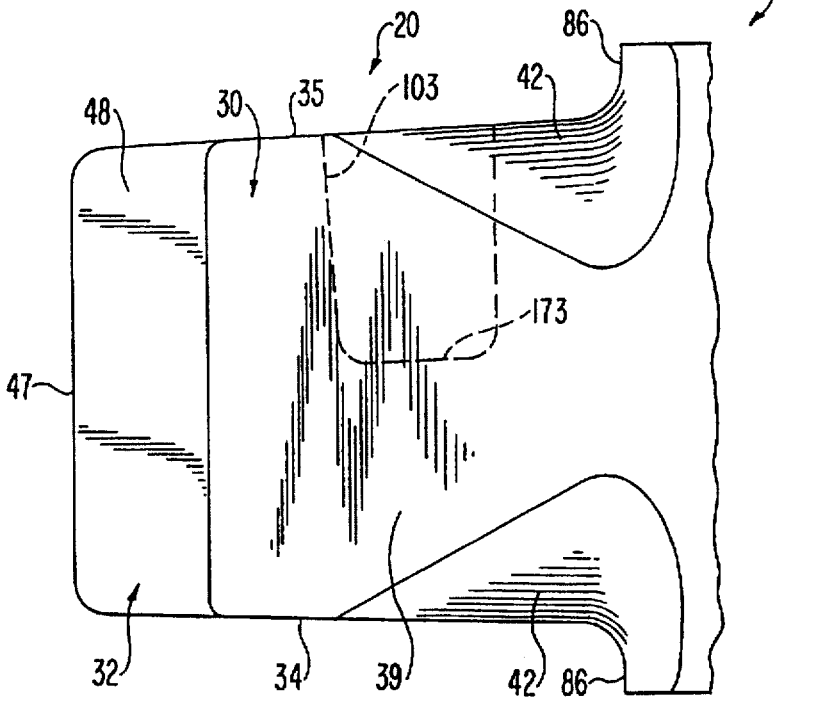
FIG. 5 is a partial bottom plan view of the adapter.
Figure 6:
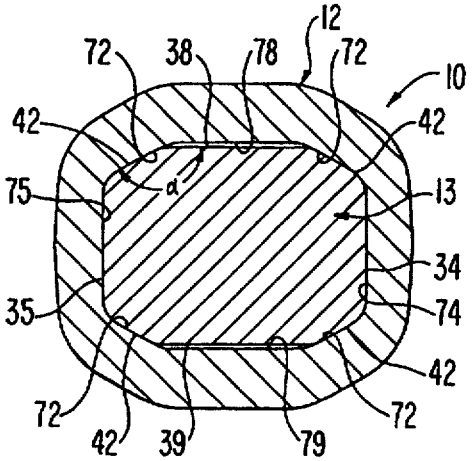
FIG. 6 is a cross-sectional view taken along line 6—6 in FIG. 1.
Figure 7:
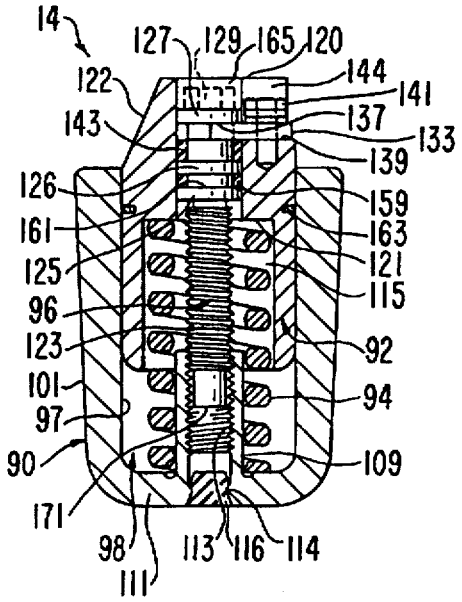
FIG. 7 is a sectional view of an extensible lock in accordance with the present invention.

An excavating tooth 10 in accordance with the present invention includes a point 12, an adapter 13, and a lock 14 (FIGS. 1–15). The adapter includes a rear mounting or base end 18 and a forwardly projecting nose 20 (FIGS. 1, 2 and 5). Point 12 has a generally tapered shape which forms front digging edge 15 and a rearwardly opening socket 16 for receiving nose 20 (FIG. 3). Lock 14 functions to releasably secure point 12 to adapter 13 (FIG. 7).

Figure 1:
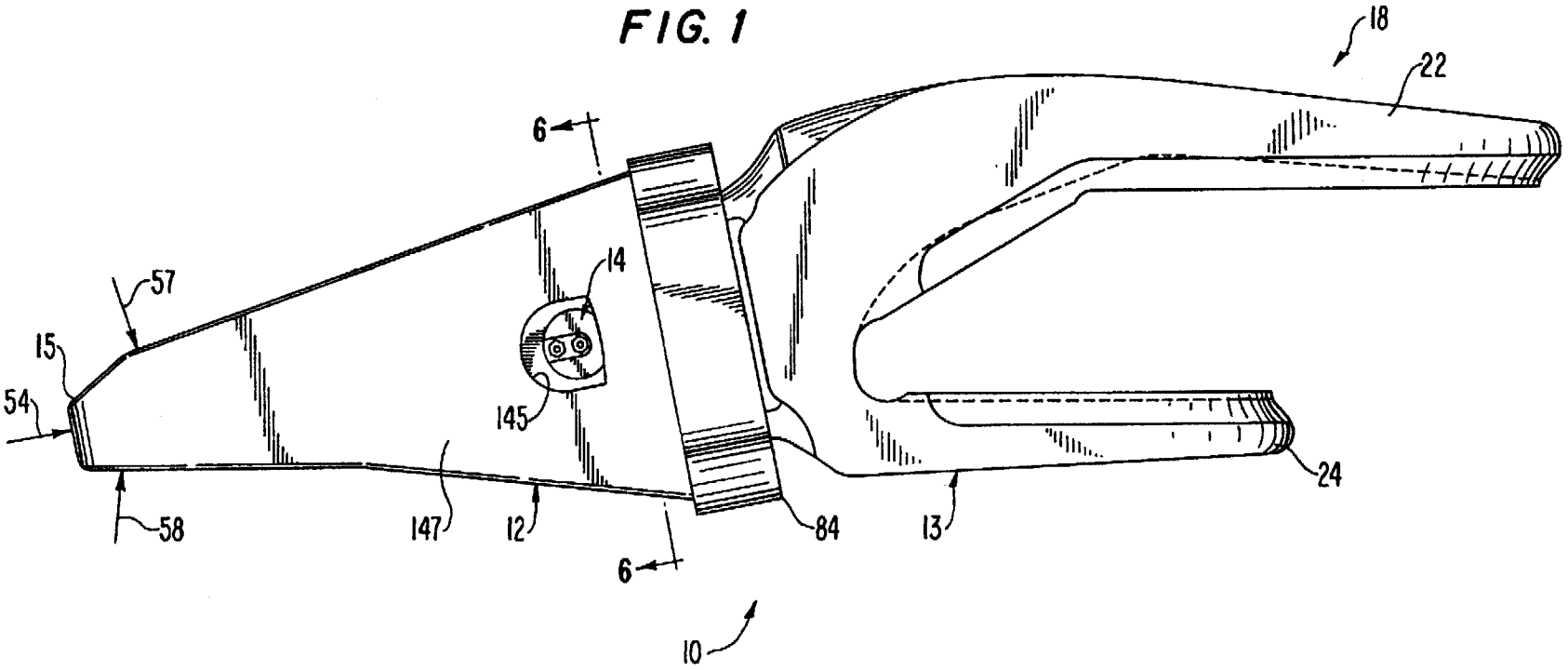
FIG. 1 is a side view of a tooth in accordance with the present invention.
Figure 2:
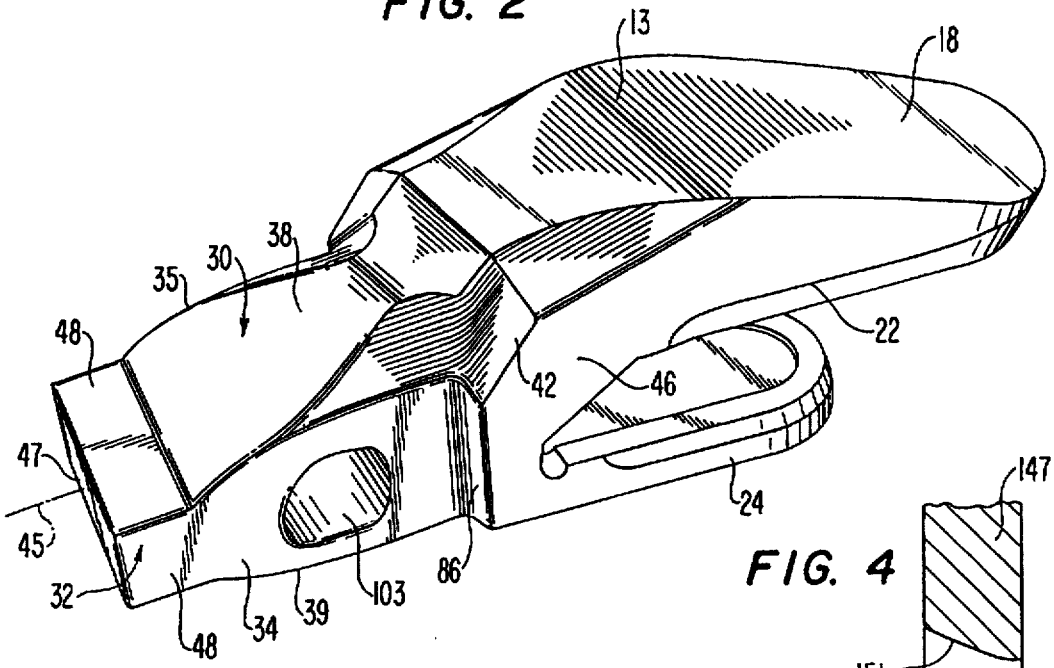
FIG. 2 is a perspective view of an adapter in accordance with the present invention.
Figure 3:
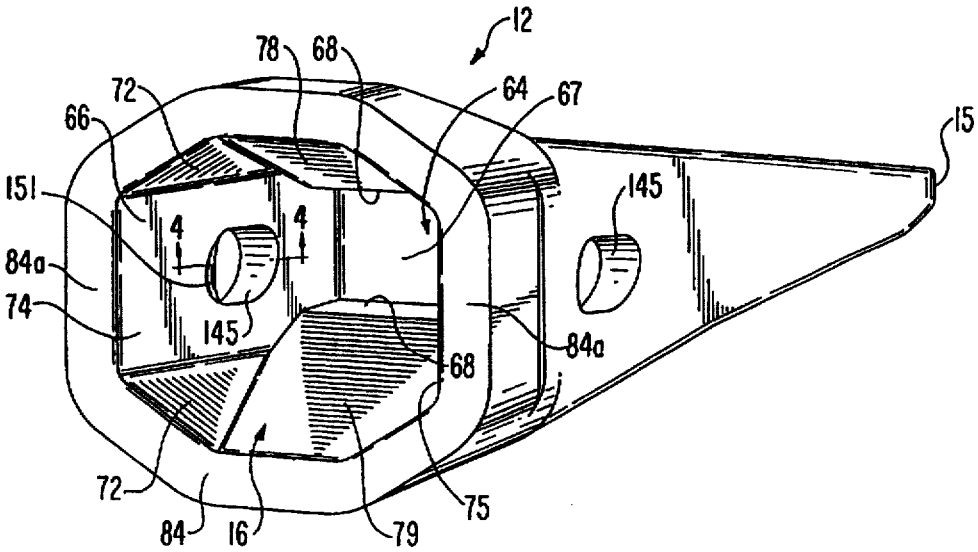
FIG. 3 is a perspective view of a point in accordance with the present invention.
Figure 40:
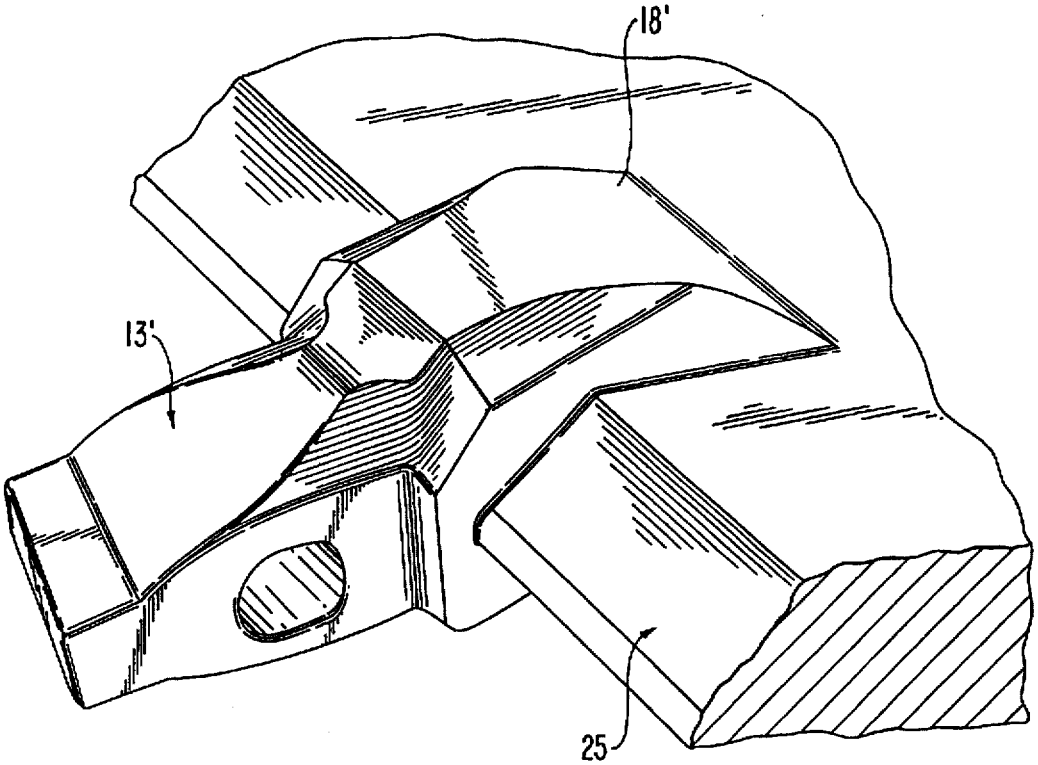
FIG. 40 is a perspective view of an alternative adapter in accordance with the first embodiment of the present invention which is integrally cast with the lip of a bucket.

The base end 18 of adapter 13 is provided with a pair of bifurcated legs 22, 24 to straddle the lip of a bucket (FIGS. 1 and 2). With this construction, legs 22, 24 are welded in place along the lip. Nevertheless, the adapter can be secured to the bucket in a number of different ways including, for example, the use of only a single welded leg, a Whisler style connection, or an attachment as disclosed in co-pending U.S. patent application Ser. No. 08/554,158, filed by inventors Larren F. Jones, Robert E. McClanahan and Hezekiah R. Holland on Nov. 6, 1995, and entitled "Wear Assembly for a Digging Edge of An Excavator" which is hereby incorporated by reference. Alternatively, the base end 18' of the adapter 13' could be formed as an integrally cast portion of the lip construction 25 (FIG. 40). The concepts of the present invention have applicability to a wide array of adapter components irrespective of whether they are fixed to the lip of the excavator by welding, mechanical attachment, integrally cast or by other means.

Nose 20 of adapter 13 has a rear body portion 30 which is generally wedge shaped and a box-shaped tip portion 32 (FIGS. 1, 2 and 5). The rear body portion 30 is defined by a pair of side walls 34, 35, top and bottom walls 38, 39, and bearing faces 42. The side walls 34, 35 are generally planar surfaces which are substantially parallel to one another; although a slight taper is usually provided for manufacturing purposes. The top and bottom walls 38, 39 are tapered to define a body portion which has a generally wedge shaped configuration. A bearing face 42 is provided at each juncture of the side walls 34, 35 with the top and bottom walls 38, 39. Bearing faces 42 are substantially planar surfaces which extend longitudinally along the rear portions of nose 20 so as to be substantially parallel to the longitudinal axis 45 of the tooth.

Due to the tapering of top and bottom walls 38, 39, bearing faces 42 widen considerably as they extend rearward. The formation of large bearing areas at the rear end of the point are beneficial in providing a firm and stable resistance to the applied moment forces. As best seen in FIG. 6, bearing faces 42 are inclined to form four bevel corners for body 30 which form broad obtuse angles with walls 34–35, 38–39. In the preferred construction, the bearing surfaces are inclined at an angle $\alpha$ of about 150°–160° to the top and bottom walls 38, 39. Although the inclination of bearing faces 42 could be varied, they should have a greater horizontal orientation than vertical because of the greater loads in a vertical direction. As can be appreciated, these four bearing surfaces provide a very stable mount for the point while creating less stress concentration at the corners than a conventional tapered bearing tooth with 90° corners.

The tip portion 32 of the nose includes front, top and bottom bearing faces 47–48 which with the distal portions of sidewalls 34, 35 form a box shaped apex for nose 20 (FIGS. 2 and 5). Bearing faces 48 are substantially planar and lie substantially parallel to axis 45 of tooth 10. Front bearing face 47 extends generally orthogonally between top and bottom bearing faces 48 to resist thrust forces generally in the direction of arrow 54 (FIG. 1). As can be appreciated, rear bearing faces 42 and tip bearing faces 48 each extend substantially parallel to axis 45 to provide a stable framework for supporting point 12 under loading in vertical directions such as indicated by arrows 57, 58.

Along with being substantially parallel to axis 45, bearing faces 42, 48 form tiers of support for point 12 (FIGS. 1 and 2). More specifically, bearing faces 48 form stabilizing surfaces at the apex of nose 20 to resist the upward or downward movement of the digging edge 15 of point 12. Bearing faces 42 are spaced rearwardly from tip 32 so as to form vertically expanded tiers of bearing surfaces relative to the tip bearing faces 48. As a result, bearing faces 42 are spaced farther apart and farther from axis 45 so as to better resist the applied moment forces.

As can be appreciated, socket 16 has basically the same configuration as nose 20 (FIG. 3). In particular, socket 16 comprises a box-shaped front portion 64 at its apex and a generally wedge-shaped rear cavity 66. Front portion 64 includes front, top and bottom bearing faces 67, 68 which are adapted to abut bearing faces 47, 48 of nose 20, respectively. Likewise, cavity 66 includes bearing faces 72 which are adapted to abut bearing faces 42. Top and bottom walls 78, 79 of cavity 66 are tapered to extend generally parallel to or slightly divergent (in a rearward direction) from top and bottom walls 38, 39 of nose 20. Walls 78, 79 are, however, spaced from walls 38, 39 to ensure that the bearing engagement occurs along the engagement of bearing faces 42, 72 (FIG. 6). Cavity 66 further includes sidewalls 74, 75 which are generally parallel to sidewalls 34, 35 (FIG. 3), but slightly spaced therefrom.

In the preferred construction, rear wall 84 of point 12 includes secondary bearing segments **84*a* adjacent sidewalls 34, 35 which are adapted to abut shoulders 86 formed on the adapter 13 at the rear end of nose 20 (FIGS. 3 and 5). Bearing engagement between segments 84*a* and shoulders 86 preferably occurs after a small amount of service wear to nose end 47 to further resist thrust forces applied in the direction of arrow 54 (FIG. 1**).

As discussed above, bearing faces 42, 47–48, 67–68, 72 of nose 20 and socket 16 are substantially planar surfaces. The term "substantially planar" is intended to include not only the preferred construction as flat surfaces, but also bearing faces which are arcuated to have broad convex or concave shapes. In addition, as noted above, bearing faces 42, 48–49, 68–69, 72 extend substantially parallel to axis 45. The term "substantially parallel" is intended to include the preferred construction wherein these surfaces diverge rearwardly from axis 45 at a small angle (e.g., of about 1–7 degrees) for manufacturing purposes.

In the preferred construction, and particularly for large sized teeth, point 12 is releasably secured to adapter 13 by lock 14 (FIGS. 7–15). Lock 14 is an extensible lock member which includes a casing 90 and a lock pin 92. A spring 94 and a central screw 96 are provided in the lock for selectively moving lock pin 92 into and out of casing 90 for releasing and securing point 12.

Figure 8:
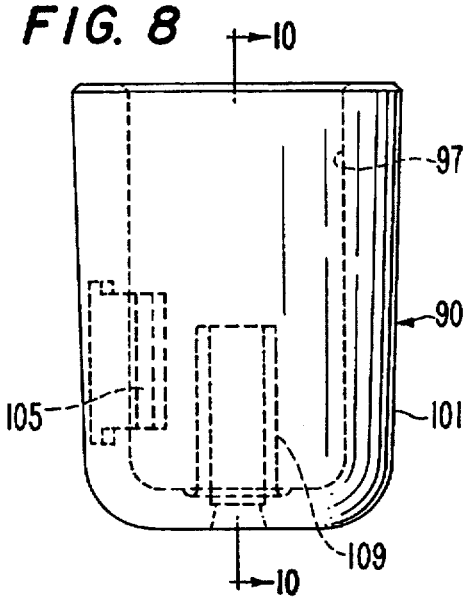
FIG. 8 is a side view of a casing for the extensible lock.
Figure 9:
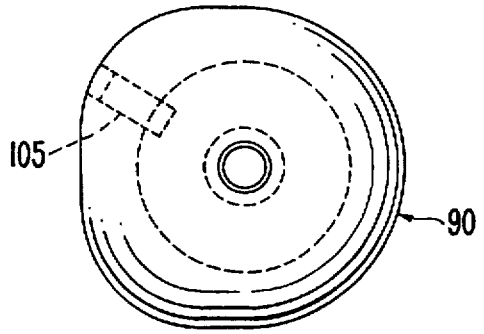
FIG. 9 is a bottom view of the casing.
Figure 10:
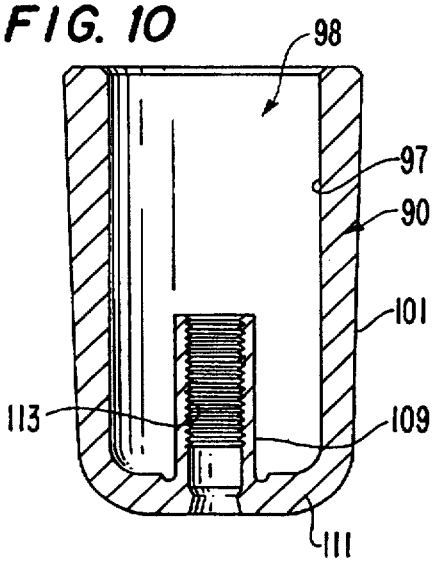
FIG. 10 is a cross sectional view taken along line 10—10 in FIG. 8.
Figure 11:
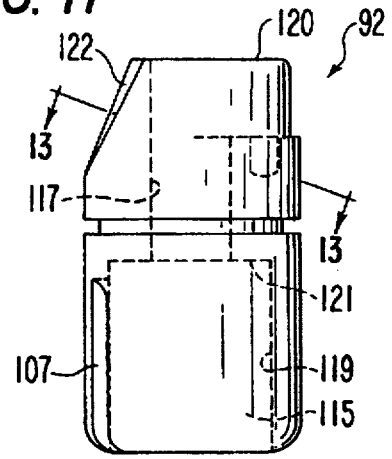
FIG. 11 is a side view of a lock pin for the extensible lock.

Casing 90 is a rigid, hollow member with an inner surface 97 that defines a generally cylindrical cavity 98 which is open on one end (FIGS. 5–8). The outer surface 101 is fit within hole 103 in sidewall 35 of adapter 13 (FIG. 2). While outer surface 101 and hole 103 are preferably D-shaped (FIG. 9) to ensure mounting of the lock in its proper orientation, other configurations could be used. A key 105 extends along inner wall 97 to cooperate with keyway 107 to prevent rotation of lock pin 92 (FIGS. 8, 9 and 11). A tubular hub 109 extends upward from the bottom wall 111 of casing 90 (FIGS. 7, 8 and 10). Hub 109 includes an internal bore 113 which is threaded over a portion of its length to receive screw 96. Bore 113 extends completely through hub 109 and bottom wall 111 to facilitate removal of the lock from hole 103 as described below. In this lower portion; bore 113 includes a rib 114, outwardly angled on the bottom side to receive a snap in place plug 116.

Figure 12:
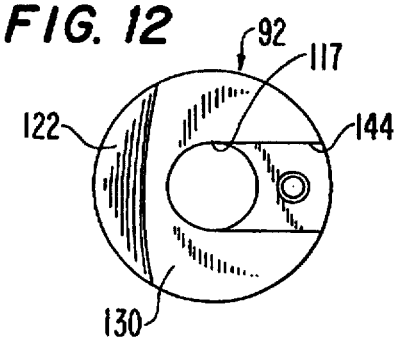
FIG. 12 is a top view of the lock pin.
Figure 13:
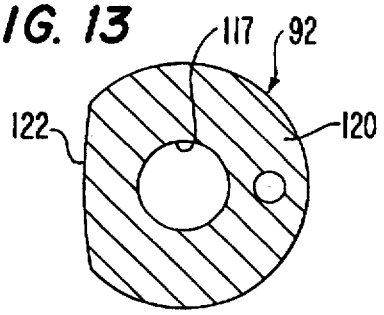
FIG. 13 is a cross sectional view taken along line 13—13 in FIG. 11.

Lock pin 92 is matingly received for slidable movement into and out of cavity 98 (FIGS. 7 and 11–13). A graduated opening 115 having a narrow segment 117 and a wide segment 119 extends through the lock pin. Full assembly of the inventive tooth places the spring 94 in compression between bottom wall 111 and shoulder 121 defined in opening 115 to bias lock pin 92 in an outward direction. Lock pin 92 further includes a head 120 with a broad arcuate face 122 for engaging the point 12. Face 122 is preferably provided with a large radius of curvature to provide secure engagement with the point even as the point shifts up and down on the adapter nose 20 (FIGS. 11–13).

Figure 14:
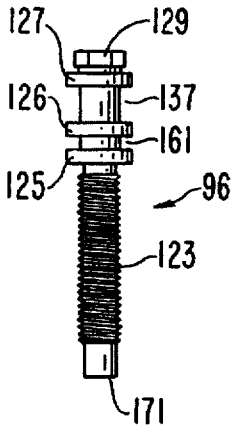
FIG. 14 is a side view of a central screw for the extensible lock.
Figure 15:
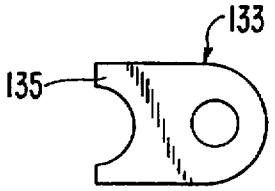
FIG. 15 is a top view of a stop plate for the extensible lock.

Central screw 96 includes a threaded shank 123, a series of spaced apart collars 125–127, and a head 129 (FIGS. 7 and 14). Shank 123 extends through opening 115 and is threadedly received in bore 113 of hub 109. A stop plate 133 provided with a claw 135 engages screw 96 in a gap 137 defined between outer collar 127 and middle collar 126 (FIGS. 7 and 14–15). Stop plate 133 is secured to the top face 139 of lock pin 92 by bolt 141 or other attachment means. An elastomeric ring 143 also lies in gap 137 between stop plate 133 and collar 126 (FIG. 7).

To install point 12 on adapter 13, lock 14 is inserted into hole 103. Screw 96, accessible in notch 144 defined in head 120, is rotated so that it moves into hub 109 and, because of the stop plate 133, drives lock pin 92 into casing 90 against the bias of spring 94. Rotation of screw 96 continues until head 120 is fully retracted into cavity 98. Point 12 can then be fit onto nose 20 of adapter 13.

Figure 4:
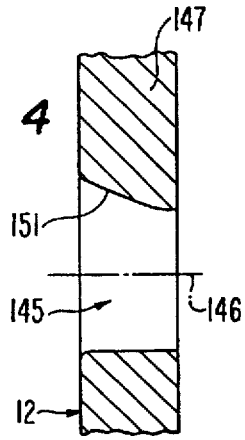
FIG. 4 is a cross sectional view taken along line 4—4 in FIG. 3.

Point 12 includes a hole 145 in at least one of the sidewalls 147 (or alternatively a converging top or bottom wall 38, 39) of the point along a generally transverse axis 146 (FIGS. 3 and 4). A hole is preferably formed in both sidewalls so the point can be reversed for longer life; although, only one hole need be provided for securing the point to the adapter. Hole 145 further preferably has a generally D-shaped configuration. Hole 145 is provided with a bearing face 151 on its rear side to matingly engage face 122 of head 120. Face 151 has a broad arcuate shape to better accommodate the rocking movement typically experienced by a point mounted on an adapter during use. Face 151 is inclined such that it converges toward the transverse axis 146 of hole 145 as it extends outward at about the same angle as face 122 (e.g., 10°–30° degrees) so that it continues to be tightly engaged by the face 122 of head 120 irrespective of the amount of wearing. Face 151 may be a single surface that converges toward the transverse axis of the hole as it extends outward, or face 151 may be a two-segmented surface which includes an inner segment that converges toward the transverse axis of the hole as it extends outward, and an outer segment that makes a smooth transition to a substantially parallel alignment to the transverse axis 146 to avoid unduly closing the hole (FIG. 4). In either event, the transversely converging portion of face 151 engages the bearing face of the lock pin for locking and tightening of the point onto the adapter.

Once point 12 is mounted onto nose 20, screw 96 is rotated to move it out of casing 90 (FIG. 7). Movement of the screw 96 carries lock pin 92 in the same direction until face 122 is firmly engaged against bearing face 151 of hole 145. As screw 96 continues to rotate it moves outward without lock pin 92 such that elastomeric ring 143 is squeezed between middle collar 126 and stop plate 133. Screw 96 is to be rotated until ring 143 creates firm resistance to any further turning. In this way, the strong force of spring 94 independently pushes on bearing face 151 to hold the point on the adapter. As the parts begin to wear, spring 94 can continue drive point 12 into a tight relationship with adapter 12 until ring 143 is completely expanded. At that point, abutment of stop plate 133 against collar 127 prevents any further outward movement of the lock pin.

Seals are provided throughout the lock to minimize the detrimental effect of soil fines (FIG. 7). In the preferred embodiment, a seal 159 is placed in gap 161 defined between collars 125, 126. A seal 163 is further provided around lock pin 92 between its exterior surface and the inner surface 97 of casing 90. An elastomeric cap 165 is preferably fit over head 129 to prevent fines from packing into the recess adapted to receive a rotation tool (not shown). Finally, elastomeric plug 116 is compressibly snap fit into the bottom of bore 113.

To remove a worn point from the adapter, screw 96 is simply rotated into hub 109 until head 120 of lock pin 92 is fully retracted into cavity 98. If the lock is heavily worn, removal of the lock can then be assisted by disengaging the screw 96 from the pin 92. This is accomplished by first turning the screw to fully extend the pin, thereby removing all spring force acting within the lock assembly. This permits easy removal of the stop plate 133. After removal of the stop plate, the screw 96 is rotated into the assembly, free of the pin 92. This downward movement of the screw will cause its lower end 171 to push plug 116 out of bore 113 so that end 171 presses against the bottom wall 173 of hole 103. Screw 96 will then push casing 90 partially out of hole 103 whereby it can be grasped and removed.

Figure 16:
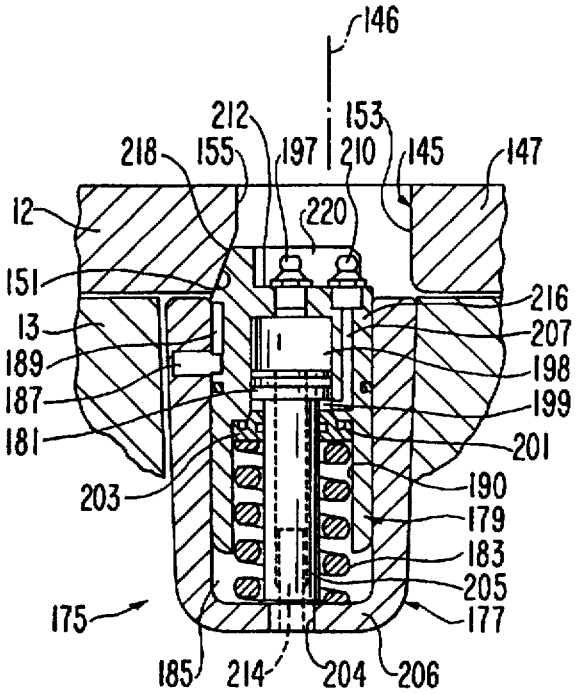
FIG. 16 is a sectional view of a second embodiment of an extensible lock mounted in a tooth assembly.

In an alternative embodiment, lock 175 can be used to secure point 12 to adapter 13 in much the same way as lock 14 (FIGS. 16–20). More specifically, lock 175 includes a generally D-shaped casing 177, a lock pin 179, a piston 181 and a spring 183. Lock 175 is adapted to be fit within hole 103 in adapter 13. Casing 177 includes a cavity 185 for receiving lock pin 179, piston 181, and spring 183. A stop 187 projects inward from casing 177 and is received in a slot 189 defined in the exterior of lock pin 179 (FIG. 16). Stop 187 functions to set the outward and inward limits of travel for lock pin 179 and to axially align the pin with the casing.

Figure 17:
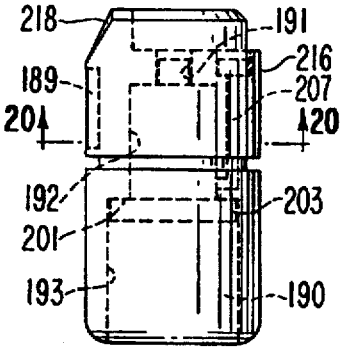
FIG. 17 is a side view of a lock pin for the second embodiment of an extensible lock.

Lock pin 179 is selectively moved into and out of cavity 185 to engage and release point 12. Lock pin 179 defines an opening 190 extending therethrough in three graduated segments 191–193 (FIGS. 16–17). The first segment 191 defines a narrow bore which is preferably threaded to securely receive a grease fitting 197 or other fluid coupling. Second segment 192 is broader than the first segment and defines chambers 198, 199 divided by piston 181. Third segment 193 is broader than the second segment to define an inner shoulder 201.

Third segment 193 is preferably threaded adjacent shoulder 201 to secure therein an annular collar 203 adapted to close chamber 199, except for the passage of piston rod 205. Hollow piston rod 205 is threadedly anchored in bore 204 in bottom wall 206 of casing 177. Spring 183 is placed in compression between collar 203 and bottom wall 206 so that it biases lock pin 179 out of casing 177. A side passage 207 is defined to extend through lock pin 179 and fluidly connect to chamber 199. A grease fitting 210 or other fluid coupling is secured at the end of passage 207 to charge and discharge grease or other fluid from chamber 199. Contained within the hollow bore of the piston rod is an ejector pin 214.

Figure 18:
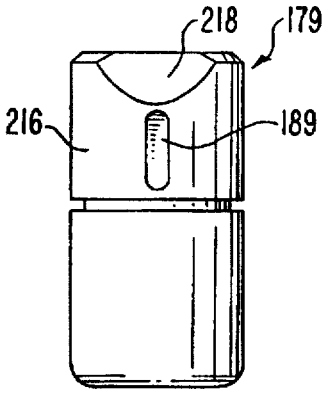
FIG. 18 is a rear view of the lock pin for the second embodiment of an extensible lock.
Figure 19:
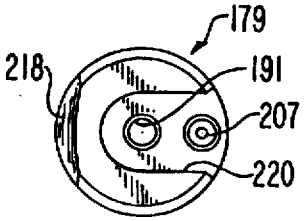
FIG. 19 is a top view of the lock pin for the second embodiment of an extensible lock.
Figure 20:
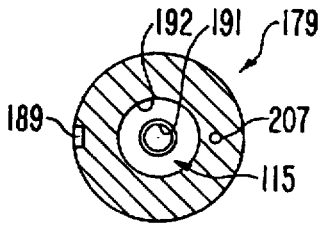
FIG. 20 is a cross-sectional view taken along line 20—20 in FIG. 17.

Lock pin 179 further has a head 216 which includes a broad arcuate bearing face 218 (FIG. 17–19). Bearing face 218 abuts against bearing face 151 of point 12 in the same way as bearing face 122 of lock 14. A notch 220 is provided to provide access to grease fittings 197, 210.

In operation, lock 175 is first inserted into hole 103 of adapter 13. Grease or other fluid is fed through passage 207 and into chamber 199 so as to retract head 216 fully into cavity 185. Point 12 is placed onto nose 20 of adapter 13. The fluid is then discharged from chamber 199 via passage 207 to permit spring 183 to push bearing face 218 of head 216 into contact with bearing face 151 of point 12 (FIG. 16). In the preferred construction, lock pin 179 is supported solely by spring 183 to hold and pull point 12 tightly onto nose 20. As an alternative, grease or other fluid may be fed into chamber 198 to hold the lock pin 179 in its extended and locked position.

To remove lock 175 from hole 103 (i.e., after the point has been removed), grease or another fluid is pumped into chamber 198. Once lock pin 178 reaches its maximum extension, continued charging of chamber 198 causes the ejector pin 214 to be forced through piston rod 205 and against bottom wall 173 of hole 103. The engagement of lock pin 179 against stop 187 will cause casing 177 to be forced out of hole 103 by the movement of ejector pin 214.

In another alternative embodiment, lock 225 comprises a casing 227, a lock pin 229, a power screw 231, and a lock bolt 233 (FIGS. 21–25). Casing 227 defines a central cavity 235 which movably receives lock pin 229. A key and keyway, as described and illustrated for lock 14, are provided to prevent turning of the lock pin. A central bore 241 extends through lock pin 229 for receipt of power screw 231. Screw 231 includes a threaded shank portion 243 and a head portion 245. Shank portion 243 and bore 241 are each formed with large mating threads 247 (preferably about 1 inch (25 mm) or greater diameter) for movement of lock pin 229 in and out of casing 227.

Figure 21:
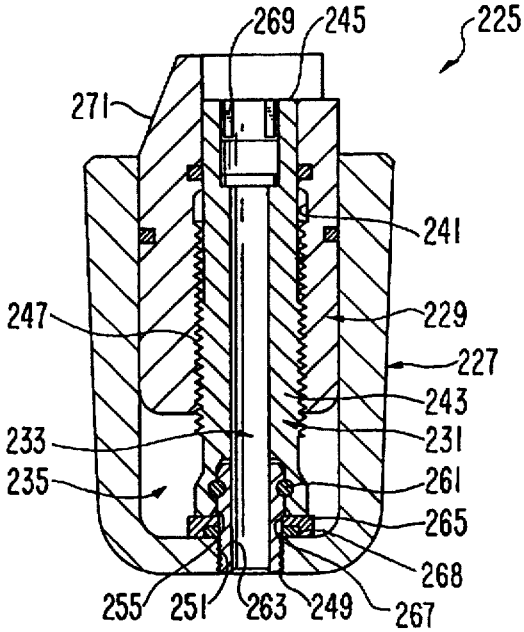
FIG. 21 is a sectional view of a third embodiment of an extensible lock.
Figure 22:
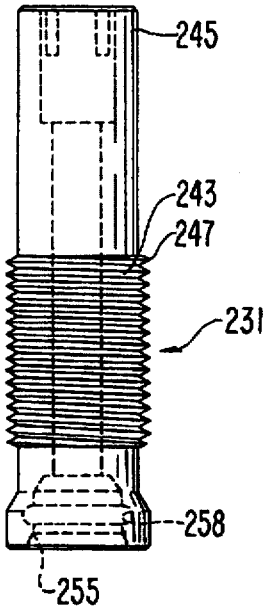
FIG. 22 is a side view of a power screw for the third embodiment of an extensible lock.
Figure 24:
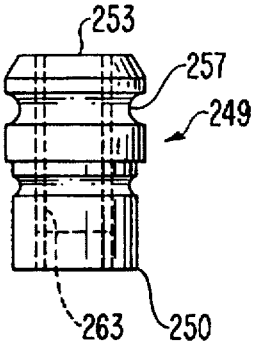
FIG. 24 is a side view of an anchor for the third embodiment of an extensible lock.
Figure 23:
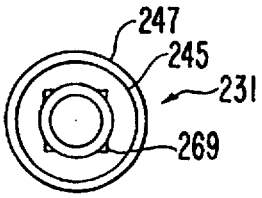
FIG. 23 is a top view of the power screw.
Figure 25:
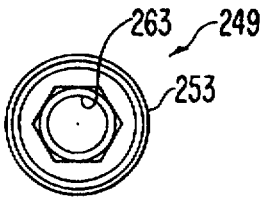
FIG. 25 is a bottom view of the anchor.
Figure 26:
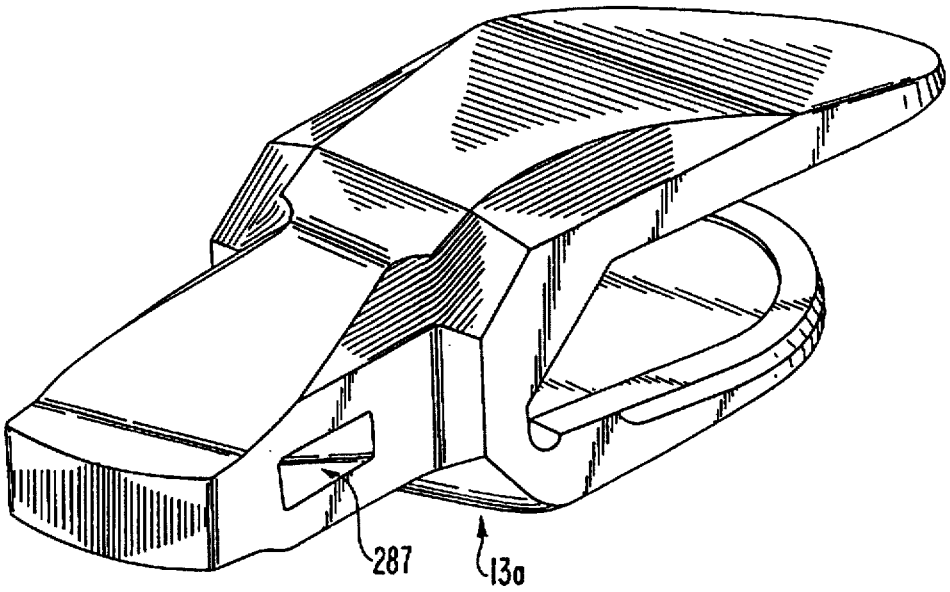
FIG. 26 is a perspective view of an adapter in accordance with a second embodiment of an excavating tooth.
Figure 27:
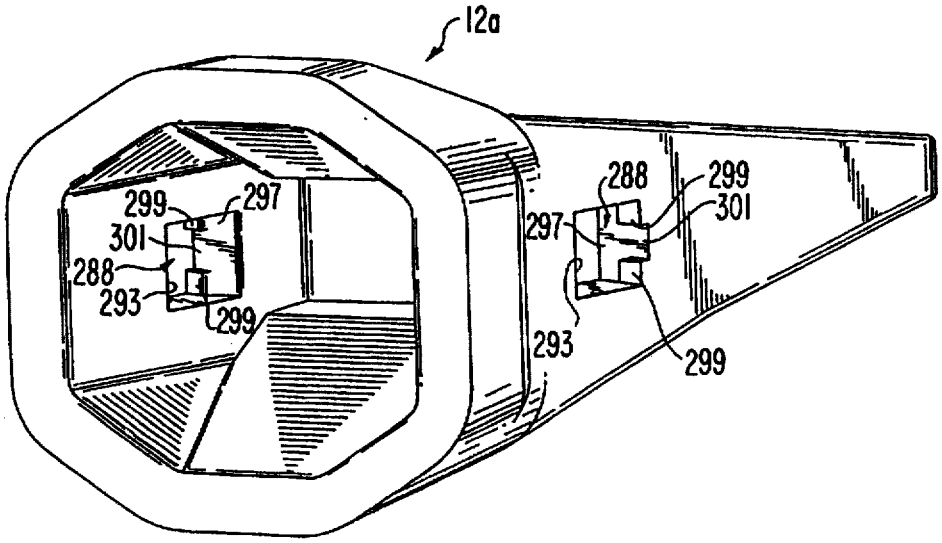
FIG. 27 is a perspective view of a point in accordance with the second embodiment of a tooth.
Figure 28:
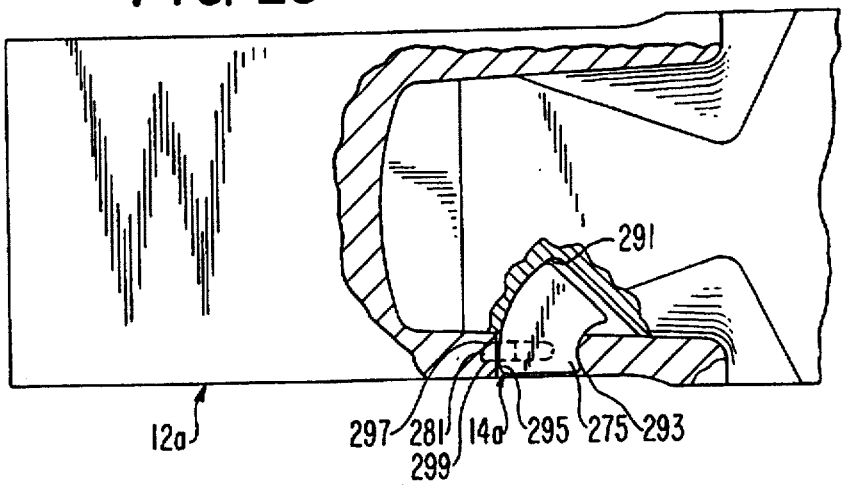
FIG. 28 is a partial top view in partial section of the second embodiment of a tooth.
Figure 29:
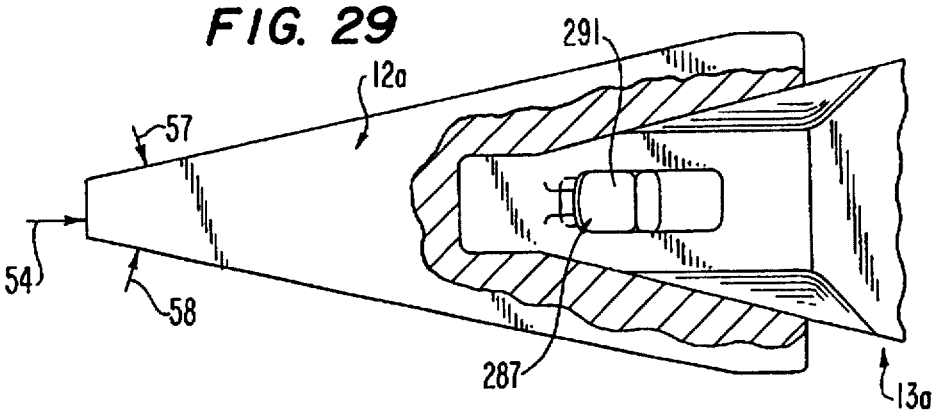
FIG. 29 is a partial side view in partial section of the second embodiment of a tooth without a lock.
Figure 30:
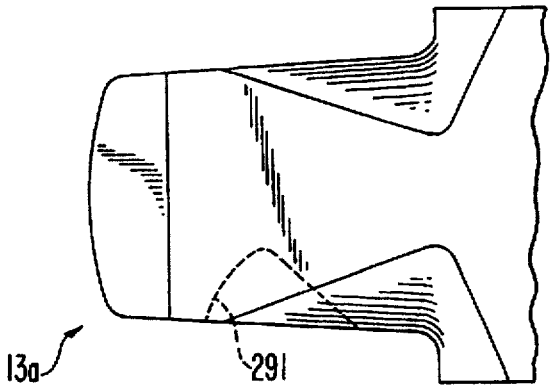
FIG. 30 is a partial top view of the adapter for the second embodiment of a tooth.

At the base of lock 225 is provided an anchor 249 which acts as a base for power screw 231 and lock bolt 233. Anchor 249 includes a threaded shank portion 250 which is secured into threaded bore 251 in casing 227, and an upstanding head portion 253 which is received into a recess 255 defined in the end of power screw 231. Mating grooves 257, 258 are provided in head portion 253 and recess 255 for receiving a snap ring 261, which holds the two components 231, 249 together. A threaded bore 263 in anchor 249 threadedly receives lock bolt 233. The bottom end of bore 263 has a square or hex recess (FIG. 25), which permits it to be tightened in thread bore 251. The bottom of power screw 231 sets on base 265 which includes a central aperture 267 through which anchor 249 extends and a counter bore 268 for a disc shaped seal (FIG. 21).

In use, a wrench or the like (not shown) engages and rotates power screw 231 via flats 269. Turning of the power screw causes lock pin 229 to retract in cavity 235 so that point 12 can be placed on adapter 13. Power screw 231 is then rotated in the other direction as far as it will go to drive bearing face 271 of lock pin 229 outward and against rear face 151 of hole 145. Once power screw 231 is fully rotated, lock bolt 233 is tightened against a lock washer (not shown) so that head 273 in cooperation with base 265 clamps power screw 231 in a fixed position. This clamping arrangement prevents the power screw from loosening the lock pin during use.

Figure 31:
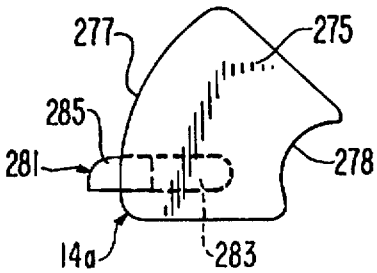
FIG. 31 is a top view of a lock of the second embodiment of a tooth.

Point **12*a* can be secured to adapter 13*a* via a different lock 14*a* (FIGS. 26–31). In this embodiment, lock 14*a* has a rigid body 275 with front and rear arcuate bearing faces 277, 278 (FIG. 31). Front bearing face 277 has a broad, convex shape defined by a large radius of curvature. Rear bearing face 278 has a concave shape which is defined by a smaller radius of curvature. In the preferred construction bearing faces 277, 278 are formed about a common center. A latch 281 comprising an elastomer 283 and a rigid metallic tip 285 projects outward to retain body 275 in the tooth assembly. In the preferred embodiment, latch 281 projects from front bearing face 277**; nonetheless, the latch could project in other directions.

Complementary holes 287, 288 are defined in sidewalls 34, 147 of adapter 13 and point 12, respectively (FIGS. 26–30). Hole 287 in adapter 13 includes an arcuated front bearing wall 291 shaped to matingly abut front bearing face 277 of body 275. Likewise, hole 288 has a rear arcuate bearing wall 293 for matingly abutting against bearing face 278 of body 275. While front wall 295 of hole 288 preferably has an arcuate configuration to permit easy rotation of lock **14*a* into hole 278, it is spaced from front bearing face 277. A keeper is formed in front wall 295 to receive and retain latch 281. In the preferred construction, the latch is received in a groove 297 and retained by a tab portion 299. By receiving tip 285 in groove 297, the thrust forces resisted by bearing faces 277, 278 are not applied against the latch. As a result, elastomer 283 is only used to prevent inadvertent release of lock 14*a* from the tooth, and does not resist forces tending to pull point 12*a* from adapter 13*a*. A slot 301 is preferably formed in tab portion 299** to permit entry of a slender tool (e.g., a screw driver) to retract and release the latch from the keeper.

Figure 41:
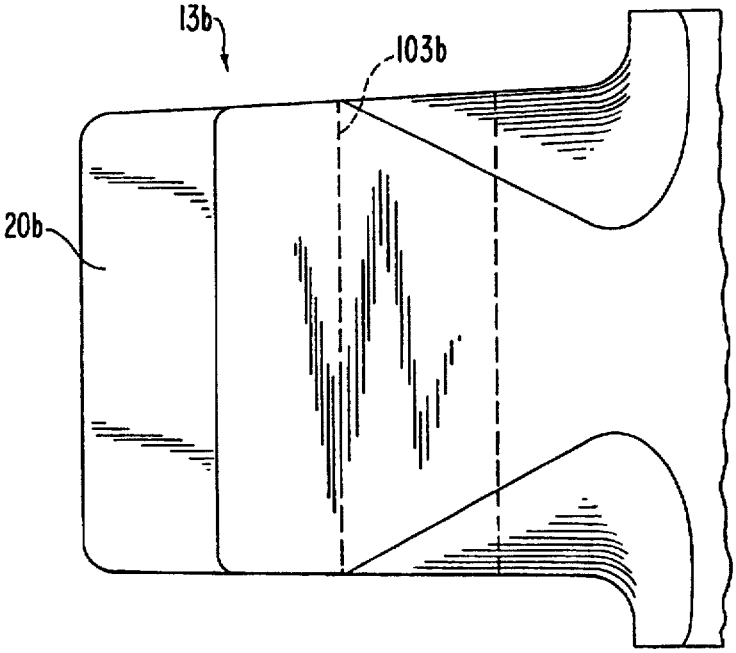
FIG. 41 is a partial top view of an alternative adapter in accordance with the present invention.

An adapter **13*b* can also be formed with a hole 103*b* extending (vertically or horizontally) completely through the nose for receipt of a conventional lock (FIG. 41). In this construction, the hole 103*b* extending entirely through the adapter nose 20*b* would be aligned with holes provided in the walls of the point. Otherwise adapter 13*b* would preferably have the same nose construction as adapter 13**.

Figure 32:
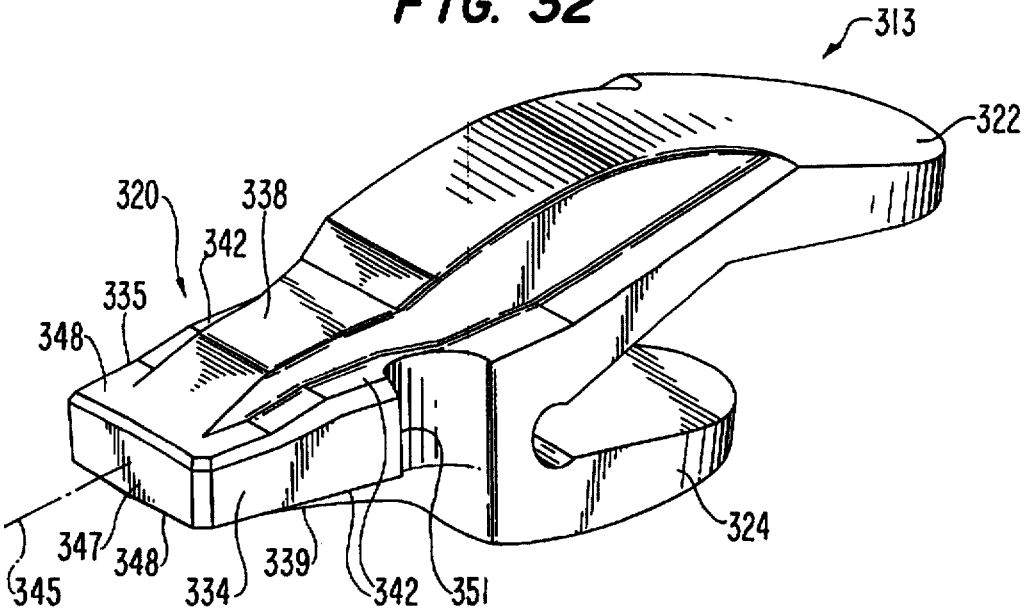
FIG. 32 is a perspective view of an adapter in accordance with a third embodiment of an excavating tooth.
Figure 33:
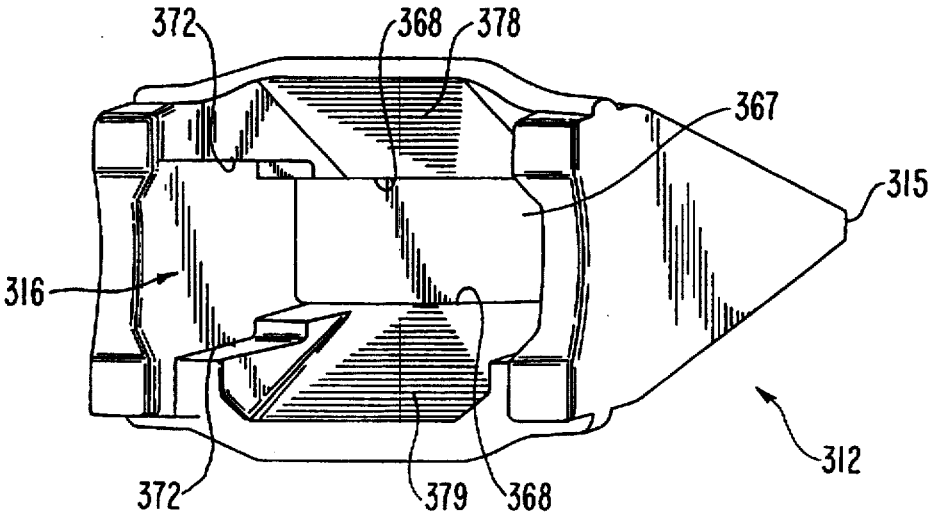
FIG. 33 is a perspective view of a point for the third embodiment of a tooth.
Figure 34:
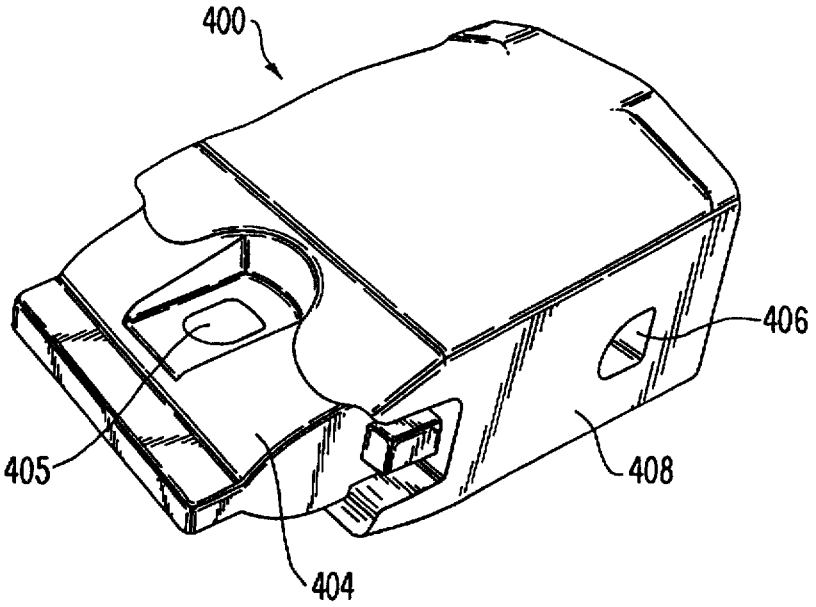
FIG. 34 is a perspective view of an alternative wear member in accordance with the first embodiment of an excavating tooth.
Figure 35:
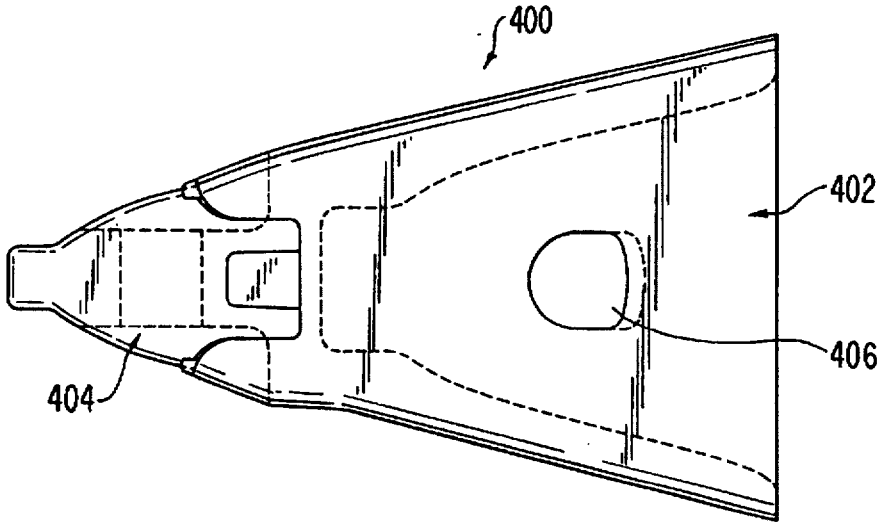
FIG. 35 is a side view of the alternative wear member.
Figure 36:
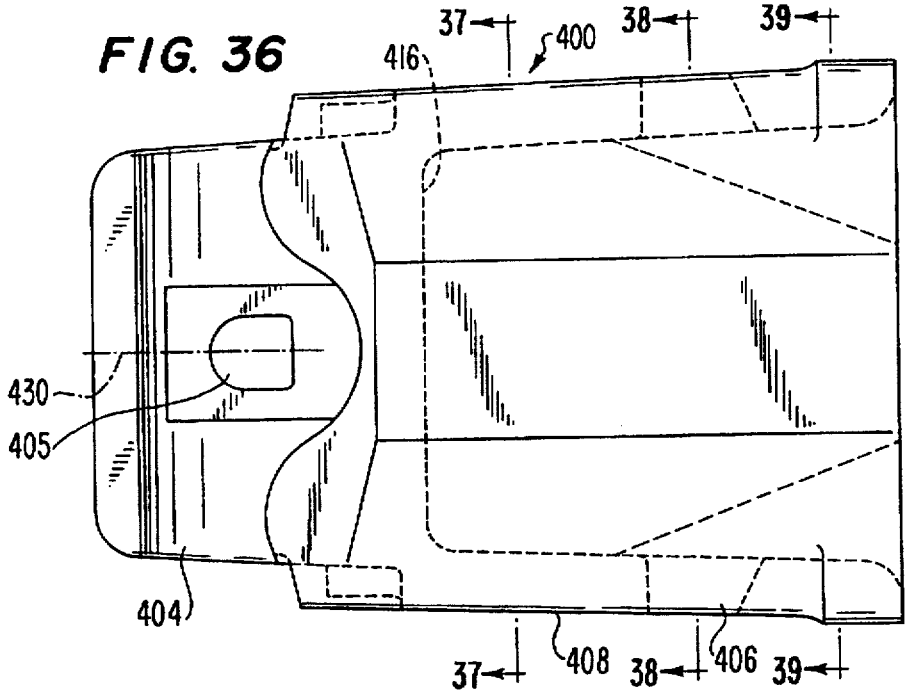
FIG. 36 is a top view of the alternative wear member.
Figure 37:
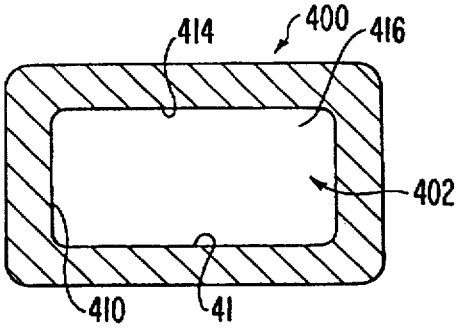
FIG. 37 is a cross-sectional view taken along line 37—37 in FIG. 36.
Figure 38:
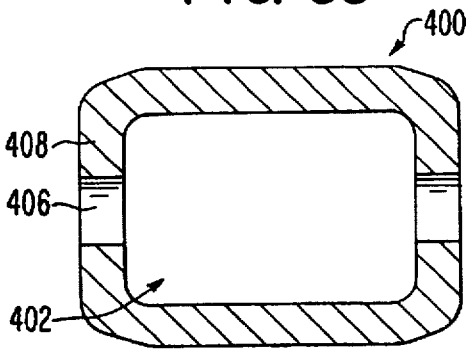
FIG. 38 is a cross-sectional view taken along line 38—38 in FIG. 36.
Figure 39:
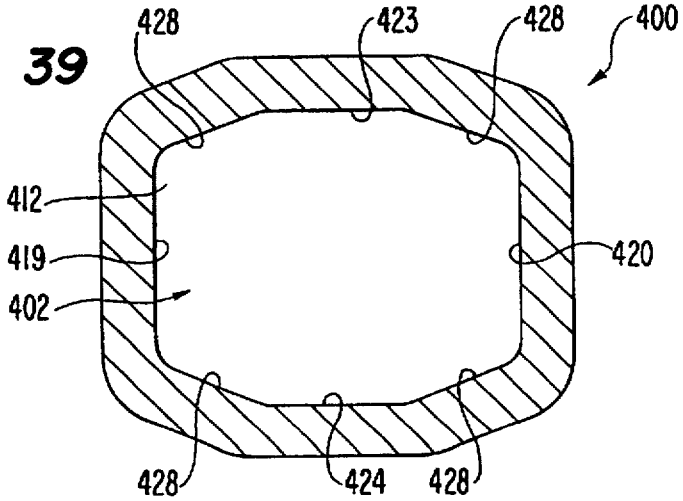
FIG. 39 is a cross-sectional view taken along line 39—39 in FIG. 36.

In an alternative embodiment, a tooth comprises a point 312 and an adapter 313 (FIGS. 32–33). Point 312 has a wedge-shaped configuration which includes a front digging edge 315 and a rearwardly opening socket 316. Adapter 313 includes rear extending legs 322, 324 which straddle the front lip of a bucket, and a forwardly projecting nose 320 for mounting the point.

Nose 320 includes a front bearing face 347 which is adapted to abut base wall 367 of socket 316 to resist thrust loads on the tooth (FIGS. 32–33). Top and bottom bearing faces 348 which lie substantially parallel to the longitudinal axis 345 of tooth 310 are provided at the apices of nose 320 and socket 316 to resist upward and downward movement of digging edge 315. In the preferred construction, bearing faces 348 are pitched slightly relative to their centers to provide a larger front bearing face 347. Nevertheless, faces 348 could be formed to extend straight across the nose without a pitch.

Top and bottom walls 338, 339 taper away from bearing faces 348 as they extend rearward in order to provide the nose with sufficient strength to withstand the applied loads during use. Along the sides of the nose are formed a second set of bearing faces 342 which also lie substantially parallel to axis 345. Bearing faces 342 are spaced not only rearwardly of bearing faces 348, but are also spaced vertically outward therefrom to provide the beneficial tier construction of the bearing faces. Generally parallel sidewalls 334, 335 define the sides of the nose. A shoulder 351 is provided along the rear end of the nose to receive a lock pin (not shown). In the preferred construction, the point is secured to the nose as disclosed in U.S. Pat. No. 5,469,648 to Emrich, which is hereby incorporated by reference. Nevertheless, other locking arrangements could be used.

Point 312 has a socket 316 which is generally matingly received over nose 320 (FIG. 33). Accordingly, socket 316 includes bearing surfaces 367, 368 which abut against bearing surfaces 347, 348 to resist the applied loads. The socket further includes rearward bearing surfaces 372 to abutting engage bearing faces 342. Top and bottom walls 378, 379 extend generally parallel or slightly diverging in a rearward direction to top and bottom walls 337, 338, but are spaced therefrom to avoid interfering with the engagement of the bearing surfaces.

The mounting constructions of the present invention can also be used to mount wear members other than points. For instance, certain large teeth comprise an adapter (not shown) secured to the digging edge of an excavator, another adapter component 400 (known as a KWIK TIP® adapter) and a point (not shown). Adapter 400 (FIGS. 34–39) has a rearwardly opening socket 402 for receipt over the nose of the adapter (not shown) secured to the digging edge and a forwardly projecting nose 404 for mounting the point (not shown). In the preferred construction, nose 404 has a conventional design for mounting the point; although the nose could be shaped in accordance with the present invention. A hole 405 is provided for receiving a lock pin and an elastomer (not shown) to secure the point to the nose. In the preferred embodiment, a hole 406 is provided in one sidewall 408 (or both if the member is reversible) of the part for receiving a lock 14 for releasably securing adapter 400 in place.

As with point 12, socket 402 is shaped to include a box-shaped inner portion 410 at its apex and a rearward cavity portion 412 (FIGS. 36–39). Inner portion 410 includes top and bottom bearing faces 414 for resisting vertical loads, and a front bearing face 416 for resisting thrust loads. Cavity portion 412 includes a pair of generally parallel sidewalls 419, 420 a pair of rearwardly diverging top and bottom walls 423, 424, and four bearing faces 428 in each corner of the socket. Bearing faces 428 are formed in the same way as bearing faces 42 described above. Bearing faces 428 extend substantially parallel to the longitudinal axis 430 of the tooth to form a stabilized tooth construction. Moreover, bearing faces 428 are positioned farther from axis 430 to form a tier construction with bearing faces 414.

The above discussion concerns the preferred embodiments of the present invention. Various other embodiments as well as many changes and alterations may be made without departing from the spirit and broader aspects of the invention as claimed.

We claim:

1. An excavating tooth comprising:

an adapter having a rear base end for fixed engagement to a digging edge of an excavator, and a forwardly projecting nose;

a wear member having a longitudinal axis, a forward end and a rearwardly opening socket for receiving said nose of said adapter, said socket being defined by a pair of converging walls tapering toward said forward end, a pair of side walls, a plurality of first bearing faces extending substantially parallel to said longitudinal axis, and a plurality of second bearing faces extending substantially parallel to said longitudinal axis, said first bearing faces being spaced farther from said longitudinal axis than said second bearing faces, and each said first bearing face being located between one of said converging walls and one of said side walls; and a lock for releasably securing said wear member to said adapter.

2. An excavating tooth in accordance with claim 1, in which said socket has a front end and a rear end, and said first bearing faces are spaced rearward of said second bearing faces.

3. An excavating tooth in accordance with claim 1, in which said wear member is a point and said forward end forms a digging edge.

4. An excavating tooth in accordance with claim 1, in which said wear member is an adapter member and said forward end is a nose member, and wherein said tooth further includes a point mounted on said nose member.

5. An excavating tooth in accordance with claim 1, which further includes a third bearing face extending generally orthogonally to said second bearing faces at said forward end of said socket and fourth bearing faces extending generally parallel to said third bearing face along a rear wall of said wear member, wherein said third and fourth bearing faces resist axial loading on said wear member.

6. An excavating tooth comprising:

an adapter having a rear base end for fixed engagement to a digging edge of an excavator, and a forwardly projecting nose;

a wear member having a longitudinal axis, a forward end and a rearwardly opening socket for receiving said nose of said adapter, said socket being defined by a pair of converging walls, a pair of side walls, and a plurality of bearing faces extending substantially parallel to said longitudinal axis, each said bearing face extending between one of said converging walls and one of said side walls at obtuse angles thereto; and a lock for releasably securing said wear member to said adapter.

7. An excavating tooth in accordance with claim 6, in which each said bearing face widens significantly as it extends in a rearward direction.

8. A excavating tooth in accordance with claim 6, in which said socket has a front end and a rear end, and each said bearing face is adjacent said rear end.

9. An excavating tooth in accordance with claim 6, in which said socket further includes a plurality of second bearing faces at said front end, each of said second bearing faces extending substantially parallel to said longitudinal axis.

10. An excavating tooth in accordance with claim 9, in which said first mentioned bearing faces are spaced farther from said longitudinal axis than said second bearing faces.

11. An excavating tooth comprising:

an adapter having a rear base end for fixed engagement to a digging edge of an excavator, and a forwardly projecting nose;

a wear member having a longitudinal axis, a forward end and a rearwardly opening socket for receiving said nose of said adapter, said socket being defined by a top wall and a bottom wall converging toward said forward end, a pair of side walls, and a plurality of bearing faces extending substantially parallel to said longitudinal axis, each said bearing face having a front end and a rear end such that the rear end is substantially wider than said front end; and a lock for releasably securing said wear member to said adapter.

12. An excavating tooth in accordance with claim 11, in which said socket has a front end and a rear end, and each said bearing face is adjacent said rear end.

13. An excavating tooth in accordance with claim 12, in which said socket further includes a plurality of second bearing faces at said front end, each of said second bearing faces extending substantially parallel to said longitudinal axis.

14. An excavating tooth in accordance with claim 13, in which said first mentioned bearing faces are spaced farther from said longitudinal axis than said second bearing faces.

15. A wear member for an excavating tooth having a longitudinal axis, a forward end and a rearwardly opening socket for receiving a nose of an adapter, said socket being defined by a pair of converging walls tapering toward said forward end, a pair of side walls, a plurality of first bearing faces extending substantially parallel to said longitudinal axis, and a plurality of second bearing faces extending substantially parallel to said longitudinal axis, said first bearing faces being spaced farther from said longitudinal axis than said second bearing faces, and each said first bearing face being located between one of said converging walls and one of said side walls.

16. A wear member in accordance with claim 15, in which said socket has a front end and a rear end, and said first bearing faces are adjacent said rear end.

17. A wear member in accordance with claim 16, in which said second bearing faces are located at said front end of said socket.

18. A wear member in accordance with claim 15, in which said socket has a front end and a rear end, and said second bearing faces are located at said front end of said socket.

19. A wear member in accordance with claim 15, wherein one of said side walls includes a hole extending therethrough along a transverse axis for receiving a lock, said hole has a rear face and a front face, and said rear face at least partially converges toward said transverse axis when extending away from said socket.

20. A wear member in accordance with claim 15, wherein one of said side walls includes a hole extending therethrough along a transverse axis for receiving a lock, said hole having a keeper for releasably retaining a latch of the lock.

21. A wear member in accordance with claim 15 in which said wear member is a point and said front face forms a digging edge.

22. A wear member in accordance with claim 15 in which said wear member is an adapter member and said forward end is a nose member for mounting a second wear member.

23. A wear member for an excavating tooth having a longitudinal axis, a forward end and a rearwardly opening socket for receiving a nose of an adapter, said socket being defined by a pair of converging walls, a pair of side walls, and a plurality of bearing faces extending substantially parallel to said longitudinal axis, each said bearing face extending between one of said converging walls and one of said side walls at obtuse angles thereto.

24. A wear member in accordance with claim 23, in which each said hearing face having a front end and a rear end such that the rear end is substantially wider than said front end.

25. A wear member in accordance with claim 23, in which said socket has a front end and a rear end, and said bearing faces are adjacent said rear end.

26. A wear member in accordance with claim 25, in which said socket further includes a plurality of second bearing faces at said front end, each of said second bearing faces extending substantially parallel to said longitudinal axis.

27. A wear member in accordance with claim 26, in which said first mentioned bearing faces are spaced farther from said longitudinal axis than said second bearing faces.

28. A wear member in accordance with claim 23, in which said bearing faces are substantially planar.

29. A wear member in accordance with claim 23, in which each said bearing face is inclined at an angle of at least 135° relative to an adjacent one of said converging walls.

30. A wear member for an excavating moth having a longitudinal axis, a forward end and a rearwardly opening socket for receiving a nose of an adapter, said socket being defined by a top wall and a bottom wall converging toward said forward end, a pair of side walls, and a plurality of bearing faces extending substantially parallel to said longitudinal axis, each said bearing face having a front end and a rear end such that the rear end is substantially wider than said front end.

31. A wear member in accordance with claim 30, in which said socket has a front end and a rear end, and said bearing faces are adjacent said rear end.

32. A wear member in accordance with claim 31, in which said socket further includes a plurality of second bearing faces at said front end, each of said second bearing faces extending substantially parallel to said longitudinal axis.

33. A wear member in accordance with claim 32, in which said bearing faces adjacent the rear end are spaced farther from said longitudinal axis than said second bearing faces.

34. A wear member in accordance with claim 30, in which said bearing faces are substantially planar.

35. A wear member for an excavating tooth having top, bottom and side walls, a forward end and a rearwardly opening socket, said top and bottom walls converging in a forward direction to said forward end, one of said walls including a hole extending therethrough along a transverse axis for receiving a lock, said hole having a rear face and a front face, said rear face having a first segment converging toward said transverse axis when extending away from said socket and a second segment outward of said first segment extending substantially parallel to said transverse axis.

36. A wear member in accordance with claim 35, in which said first segment is arcuated to conform to a relatively large radius of curvature.

37. A wear member in accordance with claim 35 wherein said hole extends in one of said sidewalls.

38. A wear member for an excavating tooth having top, bottom and side walls, a forward end and a rearwardly opening socket, said top and bottom walls converging in a forward direction to said forward end, one of said walls including a hole extending therethrough along a transverse axis for receiving a lock, said hole having a rear face forming a convex arcuated bearing face, and one face of said hole further including a keeper for releasably retaining a latch of the lock.

39. A wear member in accordance with claim 38, in which said hole includes a front face opposite said rear face, wherein said keeper is defined in said front face.

40. A wear member in accordance with claim 39, in which said keeper is a groove for releasably retaining said latch.

* * * * *